United States Patent [19]

Howard et al.

[11] 4,062,762

[45] Dec. 13, 1977

[54] PROCESS FOR DESULFURIZING AND BLENDING NAPHTHA

[76] Inventors: Kent A. Howard, 8234 Old Hammond; William E. Winter, Jr., 11852 Parkmeadow Ave.; Karsten H. Moritz, 13030 Norma Court, all of Baton Rouge, La. 70816; John D. Paynter, 12666 Glenhaven Drive, Baton Rouge, La. 70815

[21] Appl. No.: 723,152

[22] Filed: Sept. 14, 1976

[51] Int. Cl.[2] ..... C10G 34/00; C10G 23/00; C10G 29/04

[52] U.S. Cl. ..... 208/211; 208/208 M; 208/218

[58] Field of Search ..... 208/211, 208 M, 218, 208/189

[56] References Cited

U.S. PATENT DOCUMENTS

| | | | |
|---|---|---|---|
| 1,939,633 | 12/1933 | Roberts | 208/189 |
| 2,070,295 | 2/1937 | Morrell | 208/211 |
| 3,957,625 | 5/1976 | Orkin | 208/211 |

FOREIGN PATENT DOCUMENTS

| | | | |
|---|---|---|---|
| 903,348 | 8/1962 | United Kingdom | 208/208 M |

*Primary Examiner*—George Crasanakis
*Attorney, Agent, or Firm*—Marthe L. Gibbons

[57] ABSTRACT

A sulfur-containing naphtha is separated into at least three fractions. Each fraction is desulfurized separately by a different desulfurization method. Subsequently, the desulfurized fractions are recombined. The intermediate boiling point naphtha fraction is desulfurized by an alkali metal desulfurization process, preferably in the presence of added hydrogen.

14 Claims, 1 Drawing Figure

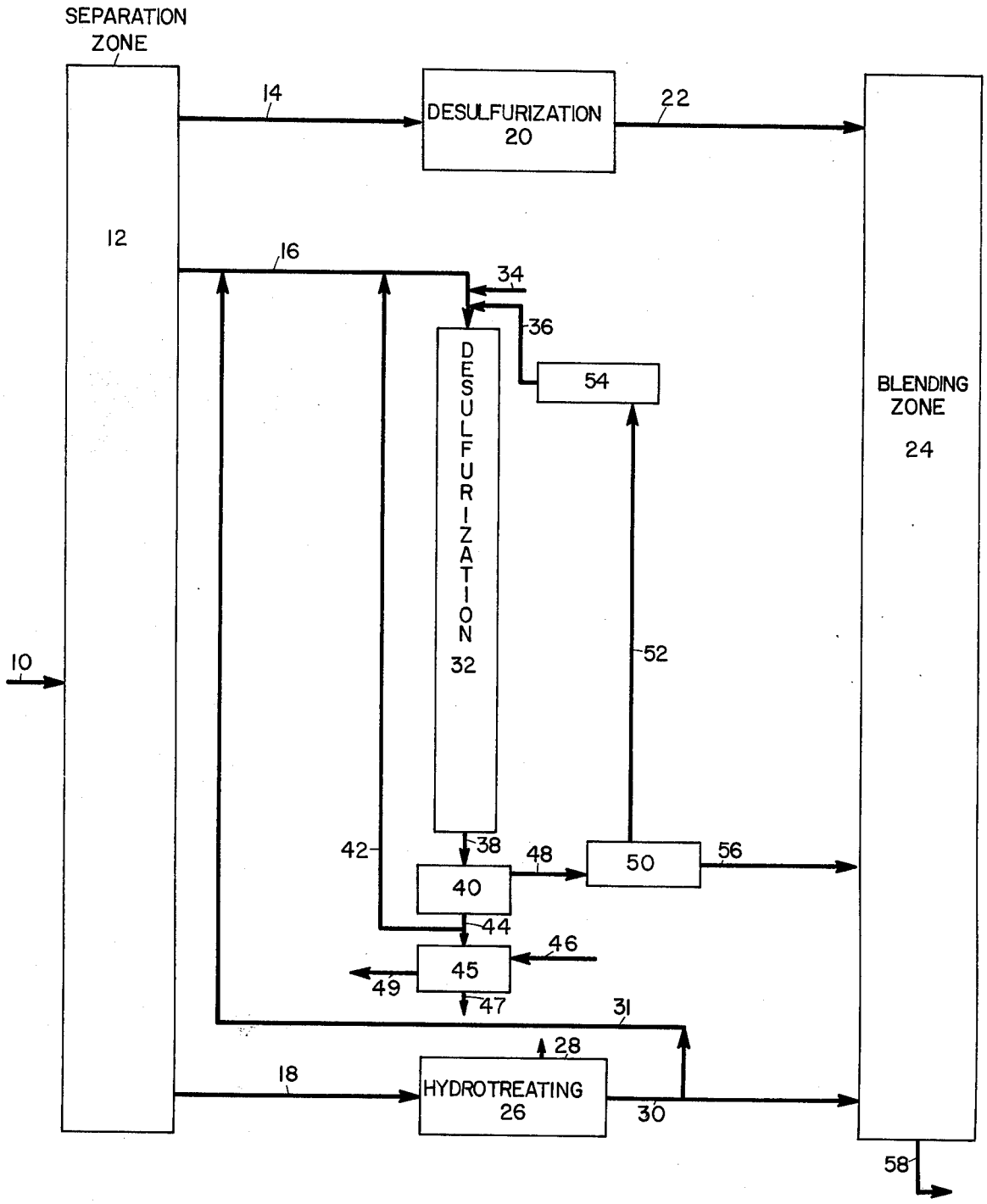
SEPARATION ZONE
12
14
DESULFURIZATION 20
22
BLENDING ZONE 24
16
34
36
54
DESULFURIZATION 32
52
10
42
38
48
50
56
40
44
46
45
49
47
31
28
18
HYDROTREATING 26
30
58

PROCESS FOR DESULFURIZING AND BLENDING NAPHTHA

BACKGROUND OF THE INVENTION

1. Field of the Invention

This invention relates to a process for the removal of sulfur from a normally liquid hydrocarbonaceous oil, particularly from a sulfur-containing naphtha fraction. More particularly, the invention relates to a desulfurization process in which the hydrocarbonaceous oil is separated into several fractions and wherein each fraction is subjected to a separate desulfurization stage. The intermediate fraction is desulfurized by a sodium treatment.

2. Description of the Prior Art

It is known to desulfurize hydrocarbonaceous oils by separating the oil into various fractions and subjecting the fractions individually to desulfurization processes in separate reaction systems, see for example, U.S. Pat. No. 3,893,909 and U.S. Pat. No. 3,440,164.

U.S. Pat. No. 2,772,211 discloses treatment of hydrocarbon stocks and petroleum distillates including catalytically cracked napththa fractions with sodium used in an amount of 0.25 to 0.5 weight percent sodium based on feedstock, that is, less than a stoichiometric amount of sodium relative to the sulfur in the fraction.

U.S. Pat. No. 1,938,670 discloses the use of sodium or potassium to desulfurize gasoline or kerosene or other petroleum distillates. The alkali metal is employed in a proportion equal to or exceeding the atomic equivalent of sulfur present. An inert gas such as hydrogen or nitrogen increases the effectiveness of sulfur removal. See also U.S. Pat. No. 1,938,672.

U.S. Pat. No. 3,004,912 discloses desulfurization of diesel oil using sodium with or without the presence of hydrogen. The sodium is used in the proportion of 1 gram atom of sodium for 1 gram atom of sulfur in the feed, that is, sodium is used in less than the stoichiometric amount required for removal of sulfur as $Na_2S$.

U.S. Pat. No. 3,787,315 discloses the desulfurization of petroleum oil stocks by contact with sodium in the presence of hydrogen followed by water treatment of the sodium salt/oil sludge.

It has now been found that a desulfurization process in which naphtha is separated into fractions which are then individually desulfurized by different desulfurization processes offers advantages that will become apparent in the ensuing description.

SUMMARY OF THE INVENTION

In accordance with the invention, there is provided a process for desulfurizing a sulfur-containing naphtha which comprises the steps of: (a) separating said naphtha into at least a lower boiling fraction, an intermediate fraction and a higher boiling fraction; (b) subjecting said intermediate fraction to an alkali metal desulfurization process; (c) subjecting said higher boiling fraction to a desulfurization process conducted in the presence of hydrogen and a hydrodesulfurization catalyst; (d) recovering desulfurized products from each desulfurization step, and (f) blending the desulfurized products and said lower boiling fraction to produce a low sulfur content naphtha.

BRIEF DESCRIPTION OF THE DRAWING

The FIGURE in a schematic flow plan of one embodiment of the invention.

DESCRIPTION OF THE PREFERRED EMBODIMENT

The preferred embodiment will be described with reference to the accompanying figure. Referring to the figure, a sulfur-containing naphtha fraction is passed by line 10 into a separation zone 12 such as a distillation zone. The term "naphtha" is used herein to refer to a mixture of hydrocarbons boiling (at atmospheric pressure) in the range of about C5 to 430° F. Preferably, the naphtha fraction is an olefin-containing naphtha such as a naphtha produced by a catalytic cracking process (cracked naphtha); naphtha produced by a coking process (coker naphtha); naphtha procuded by a steam cracking process (steam cracked naptha). Generally such feeds contain from about 0.01 to about 0.25 weight percent sulfur. In separation zone 12, the sulfur-containing naphtha is separated by conventional means, such as, distillation, into a lower boiling fraction, for example, boiling in the range from about C5 to 200° F. removed by line 14, an intermediate boiling range fraction, for example, boiling in the range of about 200° to about 330° F. removed by line 16 and a higher boiling fraction, for example, boiling in the range from about 330° to 430° F. All boiling points referred to herein unless otherwise specified are atmospheric pressure boiling points. The lower boiling fraction is removed by line 14 from separation zone 12. The lower boiling fraction may be passed directly to a blending zone without prior desulfurization. In the embodiment shown in the figure, the lower boiling fraction is passed by line 14 to a desulfurization zone 20 in which the content of mercaptans present in that fraction is reduced by extraction of the mercaptans or by conversion of the mercaptans to disulfides and removal of the disulfides in a conventional manner. A suitable process for treatment of the lower boiling fraction is the MEROX process described in *Oil and Gas Journal,* Volume 63, No. 1, Jan. 4, 1965, pages 90–93 and *Hydrocarbon Processing,* Volume 52, No. 2, Feb., 1973, pages 69–74. The MEROX process uses an iron group metal chelate catalyst in an alkaline medium to oxidize mercaptans to disulfides.

The desulfurized lower boiling fraction is removed from desulfurization zone 20 and passed by line 22 to a blending zone 24. The higher boiling fraction is passed by line 18 into a desulfurization zone 26 where it is subjected to a hydrotreating (hydrodesulfurization) process by contact with hydrogen and a conventional hydrodesulfurization catalyst. Suitable hydrodesulfurization conditions include a temperature in the range from about 400° to 800° F., a pressure in the range of about 80 to about 2000 psig, a space velocity of about 0.2 to 20 volumes of liquid fraction per hour per volume of catalyst, a hydrogen gas rate of 200 to 4000 standard cubic feet of hydrogen per barrel of liquid feed. Suitable catalysts comprise a hydrogenation component such as a metal, metal oxide or metal sulfide of Group VI and Group VIII of the Periodic Table of Elements on a suitable support, for example, cobalt molybdate or nickel molybdate on an alumina or on a silica-alumina carrier. The Periodic Table referred to herein is given in *Handbook of Chemistry and Physics,* published by the Chemical Rubber Publishing Company, Cleveland, Ohio, U.S.A., 45th Edition, 1964. A gaseous effluent comprising hydrogen sulfide and other impurities is removed from hydrodesulfurization zone 26 by line 28. The desulfurized heavy fraction is removed from the desulfurization zone 26 by line 30 and passed to blending zone 24. If desired, at least a portion of the desulfurized heavy fraction may be recycled by line 31 to line 16 for further treatment.

The intermediate fraction removed by line 16 from separation zone 12 is passed through a desulfurization zone 32 where the intermediate fraction is desulfurized by treatment with a molten alkali metal, such as sodium or potassium. Preferably, prior to introducing the intermediate fraction into desulfurization zone 32, at least a portion of a substantially sulfur-free heavy hydrocarbonaceous oil which remains in liquid phase at the alkali metal desulfurization conditions of zone 32 is added to the intermediate fraction 16. Suitable heavy hydrocarbonaceous oils for blending with the intermediate fraction to be desulfurized in zone 32 include a hydrodesulfurized recycle heavy naphtha fraction such as stream 31, other extraneous desulfurized heavy naphtha fractions including hydrodesulfurized heavy naphtha derived from catalytic cracking processes, and a 430° F. + middle distillate fraction. Mixing of the substantially sulfur-free heavy oil with the intermediate naphtha fraction prior to subjecting the intermediate naphtha fraction to the alkali metal desulfurization stage helps in maintaining a liquid phase in desulfurization zone 32.

The alkali metal treatment may be a conventional alkali metal desulfurization process such as the process exemplified by U.S. Pat. No. 1,938,670 or, preferably, the alkali metal desulfurization is conducted in the presence of added hydrogen. In the preferred desulfurization process for the intermediate naphtha fraction, zone 32 is a high turbulence pipe reactor. The intermediate fraction is desulfurized by injecting small quantities of molten alkali metal, for example, molten sodium, via line 34 into the hot feed. The amount of sodium employed is less than 1 weight percent based on feed, for example, 2.5 pounds of sodium per barrel of feed. Relative to the sulfur present in the feed to be desulfurized, the sodium will be utilized in an amount ranging from about 3 to 5 atoms of sodium per atom of sulfur present in the feed. The intermediate fraction introduced into zone 32 is maintained under sufficient pressure to remain predominately in the liquid state. A hydrogen-containing gas is introduced by line 36 into line 16 in an amount sufficient to provide a hydrogen partial pressure ranging from about 100 to about 200 psig in desulfurization zone 32. The total pressure in the desulfurization zone would generally range from about 500 to about 1000 psig. Reaction zone 32 is maintained at temperature ranging from about 450° to 650° F., preferably from about 500° to about 650° F. The sodium and intermediate boiling naphtha fraction are generally contacted for about 5 minutes or less in the high turbulence pipe reactor. The reaction zone effluent is passed by line 38 into a flash chamber 40 where the solids formed during the reaction are separated from the desulfurized intermediate naphtha boiling fraction. The solids comprise sodium, sodium mercaptides, gums, etc. Alternatively, the solids may be separated from the desulfurized intermediate fraction by centrifugation or other conventional manner. The solids or solids-slurry in flash chamber bottoms may, if desired, by recycled via line 42 to the feed carried in line 16. A portion of the spent solids may be passed by line 44 to quench tank 45 where the spent solids are contacted with water introduced by line 46. A waste stream is removed from quench tank 45 by line 47. An oil stream is removed by line 49. The desulfurized fraction and gases are passed by line 48 into a condensation zone 50 where a gaseous effluent comprising hydrogen is removed by line 52 and recycled via a hydrogen storage zone 54 to the desulfurization zone feed. The desulfurized intermediate fraction is removed from condensation zone 50 by line 56 and passed into blending zone 24. A desulfurized naphtha product is recovered from the blending zone by line 58. The following examples are presented to illustrate the invention.

EXAMPLE 1

The effect of hydrotreating various naphtha fractions on the sulfur level and on the octane number is shown in Table I. The hydrotreating conditions used for the series of tests reported in Table I were as follows: a temperature of 530° F., a pressure of 500 psig and a hydrogen supply rate of 800 standard cubic feet of hydrogen per barrel of oil feed.

TABLE I

| Catalytic[1] Naphtha Fraction | Sulfur Level ppm | RON | MON |
|---|---|---|---|
| 200/300° F. | 265 | 83.9 | 75.1 |
| | 4.9 | 77.3 | 70.4 |
| 300/380° F. | 201 | 84.6 | 77.1 |
| | 2.1 | 81.9 | 74.7 |
| 380/430° F. | 595 | 77.1 | 69.6 |
| | 5.2 | 75.4 | 68.9 |
| 110/410° F. | 820 | 84.4 | 76.8 |
| | 1.3 | 76.8 | 72.6 |
| 200/470° F. | 4560 | 85.1 | 72.7 |
| | 67 | 83.9 | 72.6 |

[1]Naphtha resulting from a catalytic cracking process.

The effect of sodium treating various naphtha fractions on sulfur level and octane number of the fraction is reported in Table II. The sodium treatment of the test reported in Table II was conducted at 315° C., 400 psig hydrogen for 45 minutes using 0.75 weight percent sodium. The heavy catalytic naphtha shown in Table II was a fraction boiling, at atmospheric pressure, in the range of 313° to 404° F. The light catalytic fraction shown in Table II was a fraction boiling, at atmospheric pressure, in the range of 150° to 384° F.

TABLE II

| | OCTANE DATA | | | | |
|---|---|---|---|---|---|
| | % Desulf. | Br. No. | RON | RON + 3 | MON |
| Heavy Cat. Naphtha | 0 | 25.5 | 90.6 | — | 81.3 |
| | — | — | 91.8 | — | 81.2 |
| | 40 | 25.2 | — | — | 82.0 |
| | 85 | 24.7 | 92.9 | — | — |
| | 90 | 24.0 | 91.7 | 97.6 | — |
| Light Cat. Naphtha | 0 | 24.2 | 84.9 | — | 78.0 |
| | — | — | 85.0 | — | 76.9 |
| | 87 | 23.8 | 84.7 | — | 76.6 |
| | — | — | 84.8 | — | 76.7 |

EXAMPLE 2

As a specific example of the combination process of the present invention, a catalytic naphtha boiling in the range of 65° to 430° F. containing 730 weight parts per million sulfur was separated into three fractions. Each fraction was subjected to a different desulfurization method. The conditions utilized and results of this experiment are summarized in Table III. As can be seen from Table III, 91% desulfurization was achieved with no loss of octane number.

TABLE III

| Cat. Naphtha Fraction | Wt. % Sulfur | Wt. % of Total Cat. Naphtha | Processing Method and Conditions | Wt. % Sulfur in Treated Fraction | $\left(\frac{RON + MON}{2}\right)$ |
|---|---|---|---|---|---|
| Fraction | Wt. % Sulfur | Cat. Naphtha | and Conditions | in Treated Fraction | |
| 65/200 | .015 | 34 | Merox | .0075 | 0 |
| 200/330° F. | .053 | 43 | Na treatment | .0075 | 0 |
| 330/430° F. | .214 | 23 | Hydrotreating 500 psig, 800 SCF/B $H_2$ 530° F. | .0010 | .5 |

What is claimed is:

1. A process for desulfurizing a sulfur-containing naphtha, which comprises the steps of:
   a. separating said naphtha into at least a lower boiling fraction, an intermediate boiling fraction and a higher boiling fraction;
   b. contacting said intermediate boiling fraction with an alkali metal to desulfurize said fraction;
   c. contacting said higher boiling fraction with hydrogen and a hydrodesulfurization catalyst to hydrodesulfurize said fraction;
   d. recovering desulfurized products from step (b) and step (c), and
   e. blending the desulfurized products recovered in step (d) and said lower boiling fraction to produce a low sulfur content naphtha.

2. The process of claim 1 wherein said sulfur-containing naphtha is an olefin-containing naphtha.

3. The process of claim 1 wherein said olefin-containing naphtha is selected from the group consisting of catalytically cracked naphtha, coker naphtha, and steam cracked naphtha.

4. The process of claim 1 wherein said lower boiling fraction is desulfurized and wherein the resulting desulfurized product is blended with the desulfurized products recovered in step (d).

5. The process of claim 1 wherein said lower boiling fraction is treated whereby mercaptans in said lower boiling fraction are converted to disulfides and wherein the resulting product is blended with the desulfurized products recovered in step (d).

6. The process of claim 1 wherein said higher boiling fraction is desulfurized under hydro-desulfurization conditions including a temperature in the range of about 400° to about 800° F., a pressure in the range from about 80 to b 2000 psig, and a hydrogen rate of about 200 to 4000 standard cubic feet of hydrogen per barrel of said higher boiling fraction.

7. The process of claim 1 wherein said intermediate fraction is desulfurized by contacting the intermediate fraction with an alkali metal, said alkali metal being present in an amount of less than 1 weight percent, based on said intermediate fraction, and with added hydrogen, the hydrogen partial pressure being maintained in a range from about 100 to about 200 psig, at a temperature ranging from about 450° to 650° F.

8. The process of claim 7 wherein said temperature ranges from about 500° to about 650° F.

9. The process of claim 7 wherein said alkali metal is sodium and wherein said sodium is used in an amount ranging from about 3 to about 5 atoms of sodium per atom of sulfur present in said intermediate fraction.

10. The process of claim 1 wherein at least a portion of the desulfurized product of said higher boiling fraction recovered in step (d) is contacted with alkali metal to further desulfurize said product.

11. A process for desulfurizing a sulfur-containing naphtha, which comprises the steps of:
   a. separating said naphtha into at least a lower boiling fraction, an intermediate fraction and a higher boiling fraction;
   b. desulfurizing said lower boiling fraction to reduce the mercaptan content thereof;
   c. contacting said intermediate fraction with an alkali metal to desulfurize said fraction, said alkali metal being present in an amount of less than 1 weight percent, based on said intermediate fraction, and with added hydrogen, the hydrogen partial pressure being maintained in the range from about 100 to about 200 psig, at a temperature ranging from about 450° to 650° F.;
   d. contacting said higher boiling fraction with hydrogen and a hydrodesulfurization catalyst to desulfurize said fraction;
   e. recovering desulfurized products from step (b), step (c) and step (d), and
   f. blending the desulfurized products recovered in step (e) to produce a low sulfur-content naphtha.

12. The process of claim 11 wherein said intermediate boiling fraction is contacted with said alkali metal and with added substantially sulfur-free heavy hydrocarbonaceous oil.

13. The process of claim 1 wherein said intermediate boiling fraction is contacted with said alkali metal and with added substantially sulfur-free heavy hydrocarbonaceous oil.

14. The process of claim 1 wherein said lower boiling fraction is desulfurized whereby mercaptans in said lower boiling fraction are extracted and wherein the resulting desulfurized product is blended with the desulfurized products recovered in step (d).

* * * * *